US005831404A

United States Patent [19]

Ishii

[11] Patent Number: 5,831,404

[45] Date of Patent: Nov. 3, 1998

[54] METHOD OF PREVENTING WIRE FROM BEING TWISTED OFF IN REINFORCING BAR FASTENING MACHINE

[75] Inventor: Syuichi Ishii, Tokyo, Japan

[73] Assignee: Max Co. Ltd., Tokyo, Japan

[21] Appl. No.: 906,246

[22] Filed: Aug. 4, 1997

[30] Foreign Application Priority Data

Aug. 2, 1996 [JP] Japan ..... 8-220520

[51] Int. Cl.[6] ..... B21F 9/02; H02P 3/08

[52] U.S. Cl. ..... 318/434; 140/93.6; 388/937

[58] Field of Search ..... 318/432, 433, 318/434; 140/93 A, 93 R, 93.2, 93.6, 111, 117, 118, 119, 122; 388/937

[56] References Cited

U.S. PATENT DOCUMENTS

| | | | |
|---|---|---|---|
| 4,252,157 | 2/1981 | Ohnishi | 140/93 A |
| 4,267,914 | 5/1981 | Saar | 192/147 |
| 4,834,148 | 5/1989 | Muguruma et al. | 140/119 |
| 4,858,312 | 8/1989 | Van Naarden | 29/861 |
| 4,901,775 | 2/1990 | Scott et al. | 140/123.5 |
| 5,217,049 | 6/1993 | Forsyth | 140/93.6 |
| 5,279,336 | 1/1994 | Kusakari et al. | 140/57 |
| 5,431,196 | 7/1995 | Forrester, Jr. et al. | 140/93.6 |

*Primary Examiner*—Bentsu Ro
*Attorney, Agent, or Firm*—Morgan, Lewis & Bockius LLP

[57] ABSTRACT

A method of preventing a wire from being twisted off in a reinforcing bar fastening machine having a wire pay-off device for paying off a wire for fastening reinforcing bars, a guide arm for guiding the wire so as to wind around a crossing point of the reinforcing bars in the form of a loop, a twisting device for performing a tying operation by twisting while picking up part of the loop of the wire wound around the crossing point of the reinforcing bars, and a cutting device for cutting the loop from the wire on a reinforcing bar fastening machine side, the method comprises the steps of: monitoring a torque of a motor for driving the twisting device from an operation start timing of the twisting device; and bringing the tying operation by twisting performed by the twisting device to an end upon detection of a peak of the torque.

3 Claims, 5 Drawing Sheets

METHOD OF PREVENTING WIRE FROM BEING TWISTED OFF IN REINFORCING BAR FASTENING MACHINE

BACKGROUND OF THE INVENTION

The invention relates to a method of preventing a wire from being twisted off in a reinforcing bar fastening machine that brings a tying operation by twisting to an end with the wire having been reliably tied by twisting.

Generally, in the case where reinforced concrete is employed for constructing buildings and structures, concrete is deposited after crisscrossing reinforcing bars have been fastened. Recently, a reinforcing bar fastening machine is used for fastening reinforcing bars. As shown in FIG. 5, such reinforcing bar fastening machine is operated in the following manner. A main switch 20 is turned on in advance, and a wire 22 is fed by operating a trigger lever 21 at the time of performing a fastening operation. Then, the thus fed wire 22 is further forwarded so as to form a loop from a curved section in the front of a guide arm 23, and such loop of the wire is wound around a crossing point of reinforcing bars 24. Then, part of the wire loop 25 is thereafter picked up with a twisting hook 26 and twisted to thereby fasten the reinforcing bars. The torque of a motor 28 that drives a twisting device 27 for turning the twisting hook 26 is measured, and when the torque of the motor reaches a predetermined value, the reinforcing bar fastening machine judges that the fastening operation has been completed, and therefore stops the operation of the twisting device (the motor 28).

However, the following troubles have occurred. A wire is twisted off before the torque of the motor reaches a predetermined value S due to variations in the type of wire and in the winding condition of wire as shown in FIG. 6(*a*), and the fastening operation is brought to an end as the torque of the motor has reached the predetermined value S before reaching the maximum Imax despite the fact that the fastened condition is loose (FIG. 6(*b*)). In order to overcome these problems, a torque adjusting dial 30 is arranged so that the torque can be changed. However, the torque setting operation must be performed by turning the dial 30 every time a different type of wire is fastened, which not only is cumbersome, but also is likely to cause trouble if no adjustment is made.

SUMMARY OF THE INVENTION

The invention has been made to overcome the aforementioned problems. The object of the invention is, therefore, to provide a method of preventing a wire from being twisted off in a reinforcing bar fastening machine, the method being capable not only of avoiding trouble such as the twisting off of the wire and a loosely fastened condition, but also of giving excellent operability by automatically bringing a tying operation by twisting to an end under an optimally fastened condition while monitoring the twisted condition of the wire.

To overcome the aforementioned problems, the invention is applied to a method of preventing a wire from being twisted off in a reinforcing bar fastening machine. The reinforcing bar fastening machine has a wire feed device for feeding a wire for fastening reinforcing bars, a guide arm for guiding the wire so as to wind around a crossing point of the reinforcing bars in the form of a loop, a twisting device for performing a tying operation by twisting while picking up part of the loop of the wire wound around the crossing point of the reinforcing bars, and a cutting device for cutting the loop from the wire on a reinforcing bar fastening machine side. In such reinforcing bar fastening machine, the method involves the steps of: monitoring a torque of a motor for driving the twisting device from an operation start timing of the twisting device; and bringing the tying operation by twisting performed by the twisting device to an end upon detection of a peak of the torque.

DETAILED DESCRIPTION OF THE PREFERRED EMBODIMENTS

A mode of embodiment of the invention will now be described with reference to the drawings.

Figure 1:
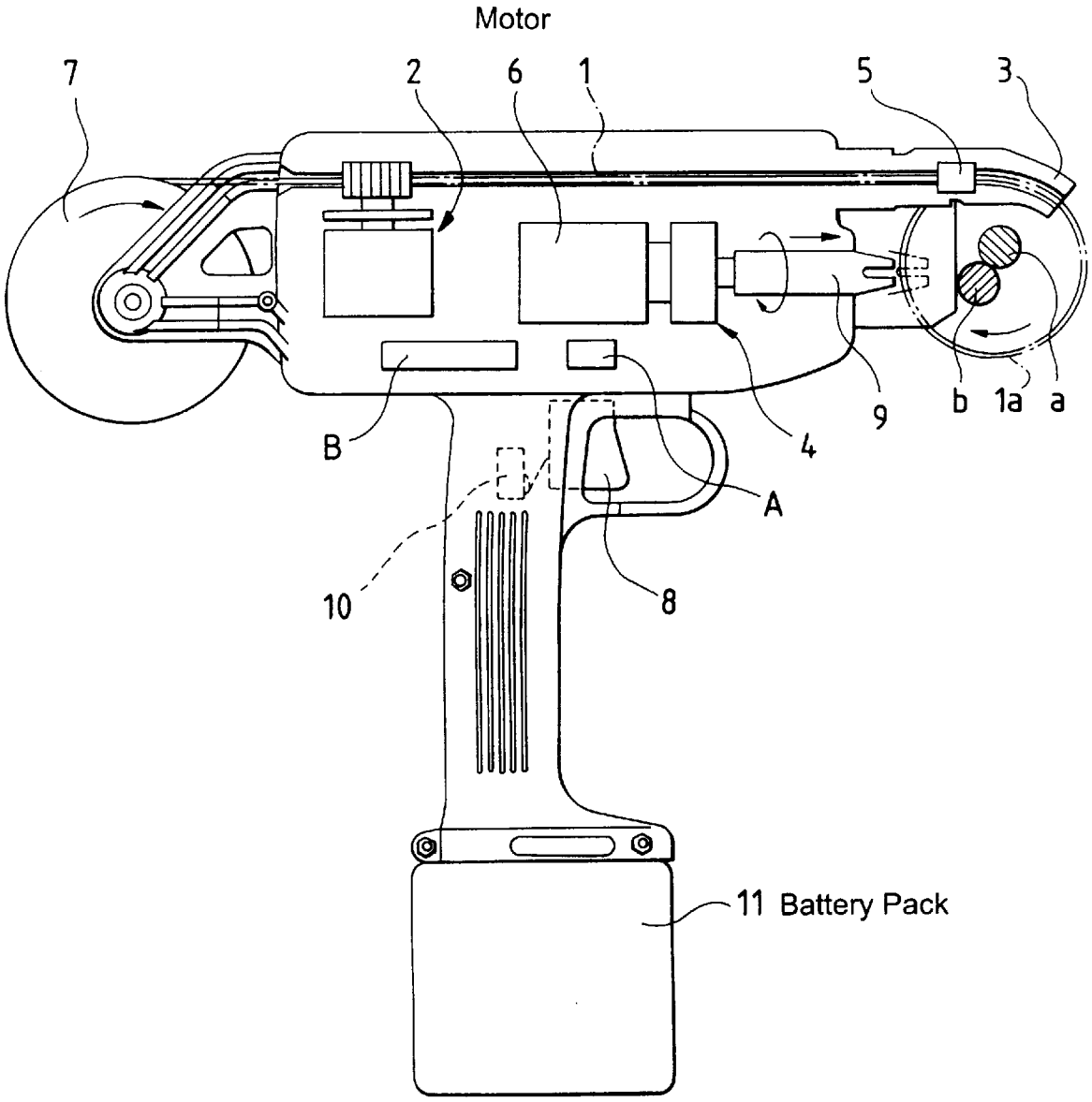
FIG. 1 is a side view of a reinforcing bar fastening machine to which a method of preventing a wire from being twisted off of the invention is applied.

FIG. 1 shows the main portion of a reinforcing bar fastening machine. This reinforcing bar fastening machine includes: a wire feed device 2 that feeds a wire 1 wound around a spool 7 forward; a guide arm 3 that forms a portion of the fed wire 1 into a loop; a twisting device 4 that picks up a portion of the looped wire 1 and ties such portion by twisting; and a cutting device 5 that cuts the wire loop so as to be separated from the wire 1 on the spool side. The wire feed device 2, the twisting device 4, and the cutting device 5 are operated by a motor mounted on the fastening machine main body.

This reinforcing bar fastening machine is operated in the following manner. A main switch is turned on in advance, and at the time of fastening reinforcing bars a, b, a trigger lever 8 is operated to thereby turn a trigger switch 10 on. As a result, the wire 1 is paid off from the spool 7 by the wire feed device 2. A portion of the thus paid-off wire 1 is formed into a loop by the guide arm 3. Then, the twisting device 4 is activated so that part of a wire loop la is picked up by a hook 9 and twisted to thereby fasten the reinforcing bars. In addition, the cutting device 5 cuts the wire loop la so that the wire loop la is separated from the wire 1 on the spool side.

By the way, this reinforcing bar fastening machine has a measuring means A that measures a torque of the motor 6 of the twisting device 4 and a control means B that judges a fastening end timing from the torque measured by the measuring means and brings the fastening operation to an end by stopping the motor 6.

Figure 2:
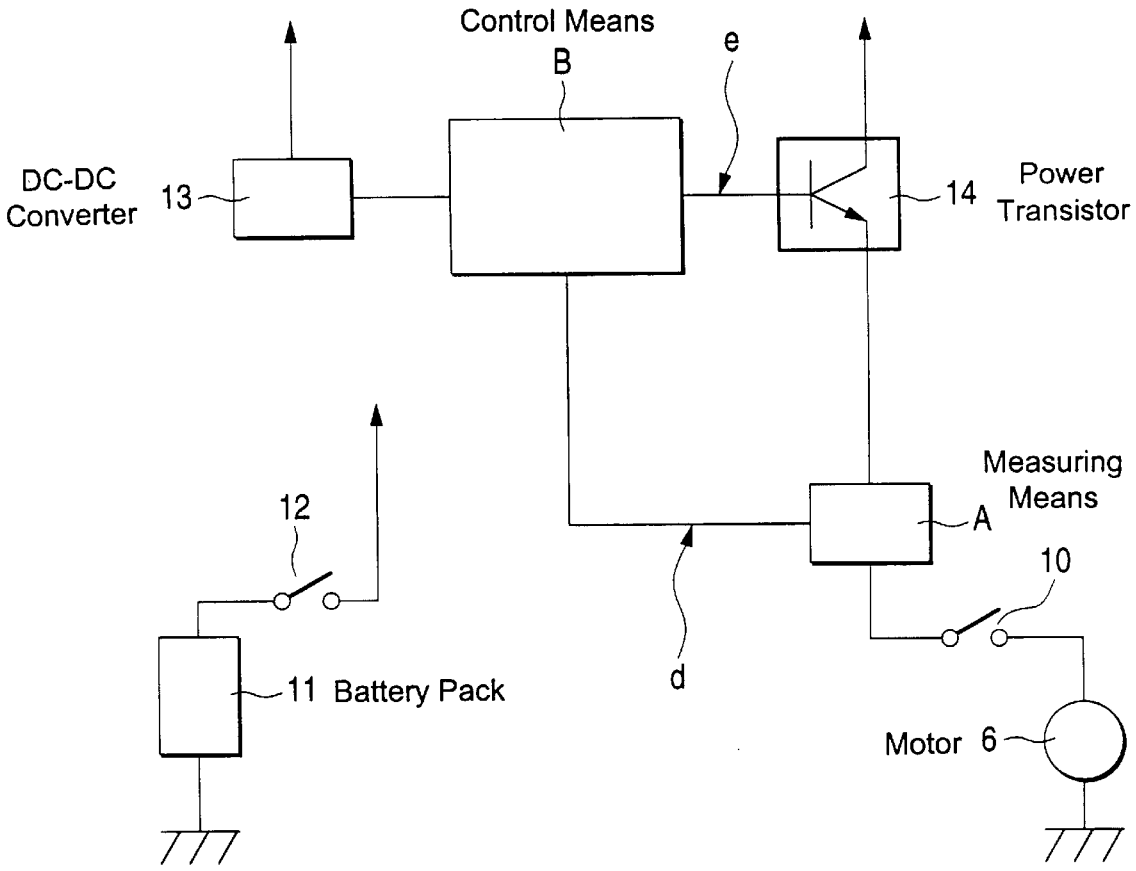
FIG. 2 is a block diagram of the reinforcing bar fastening machine.

FIG. 2 is a block diagram of the reinforcing bar fastening machine. In FIG. 2, reference character A denotes the measuring means; B, the control means; 10, the trigger switch; 11, a battery pack; 12, the main switch; and 13, a DC—DC converter that converts a voltage supplied from the battery pack to a voltage for operating the control means.

The measuring means A is connected in series to the motor 6 and measures the drive current of the motor 6. The measuring means A can measure changes in the torque of the motor 6 by measuring the drive current. The measuring means A includes a resistor, and obtains the drive current flowing through the circuit from a terminal voltage across the resistor. It may be noted that the measuring means A can be constructed of a Hall element type current sensor or the like that obtains the drive current by measuring a magnetic flux generated by the current flowing through the circuit. A measured result d obtained by the measuring means A is applied to the control means B.

The control means B is constructed of a microprocessor, and monitors changes in the torque of the motor 6 based on a control program resident in a built-in memory. By measuring the drive current, this control means B monitors an increase in the torque of the motor 6 for twisting a wire from the fact that a degree of tying by twisting is increased as the tying operation by twisting proceeds. When the torque (drive current) has reached a peak, the control means B judges that the reinforcing bar fastening force has maximized, applies a fastening end signal e, and turns off a switch (power transistor) 14 connected in series to the electric circuit of the motor 6 to thereby disconnect the electric circuit and stop the motor 6.

Figure 3:
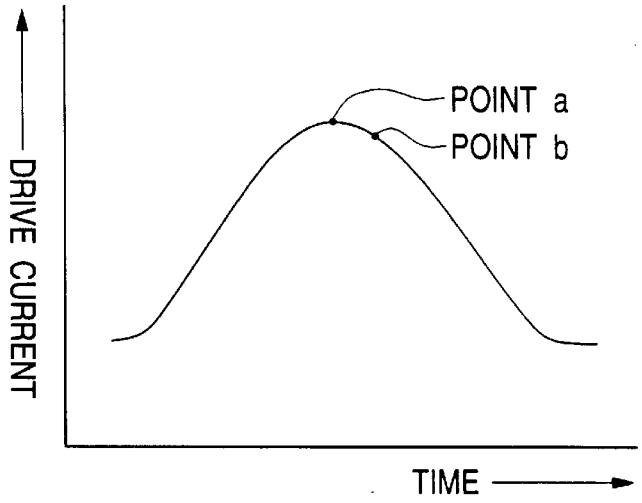
FIG. 3 is a drive current characteristic diagram showing changes in the drive current of a motor in function of time.

The fact that the torque has reached the peak is judged based on the following criterion. As shown in FIG. 3 showing a drive current characteristic curve of the motor, if the motor 6 was continuously rotated to continuously twist the wire even after the tying operation by twisting has been completed (point a), then the wire would be twisted off (point b). When the wire has been twisted off, the motor 6 has no load, so that the drive current is reduced. It is the timing at which the drive current is switched from an increase to a decrease (between point a and point b) that should be referred to as a criterion for judgment.

The fact that the torque (drive current) has reached a peak can be judged by measuring the drive current every unit time after the motor 6 started rotating, by monitoring the rate of change in the drive current every unit time, and by detecting the timing at which the rate of change has switched to a decrease.

The unit time is, for instance, 1 ms. To make sure, it may be regarded that the torque has reached a peak when the torque does not increase for four unit times, that is, 4 ms.

It may be noted that a next fastening operation can be started by turning on the switch 14 that has once been turned off on condition that the trigger switch 10 is turned off by releasing the trigger lever 8 upon completion of the current fastening operation.

According to the method of preventing a wire from being twisted off in the reinforcing bar fastening machine, when part of the wire loop la formed around a crossing point of reinforcing bars is picked up with the hook 9 and tied by twisting the hook 9 while rotating the motor 6, the timing at which the torque (drive current) of the motor 6 has maximized can be grasped. Therefore, when the motor 6 is stopped at this timing, the fastening operation can be brought to an end with the wire tied by twisting with the largest force, which in turn allows the reinforcing bars to be always fastened with the maximum fastening force. As a result, the tying operation by twisting can be performed reliably, and at the same time, the motor can be stopped immediately before the wire is twisted off.

Figure 4:
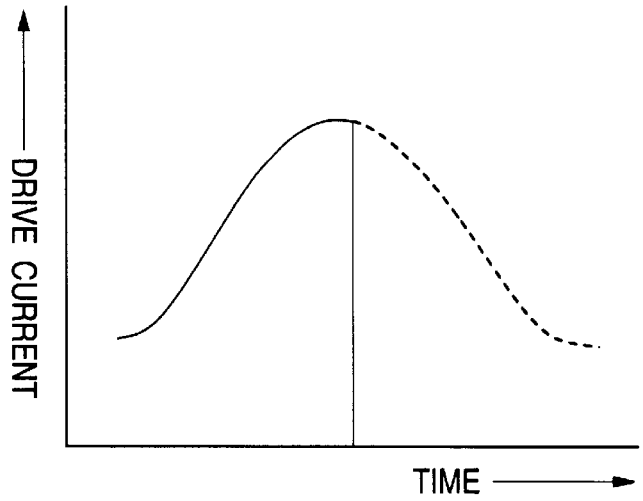
FIGS. 4(*a*) and 4(*b*) are drive current characteristic diagrams of a motor of the reinforcing bar fastening machine.
Figure 4:
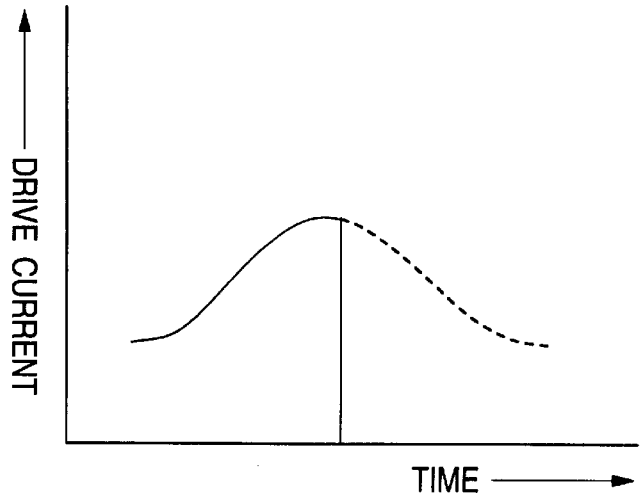
Figure 5:
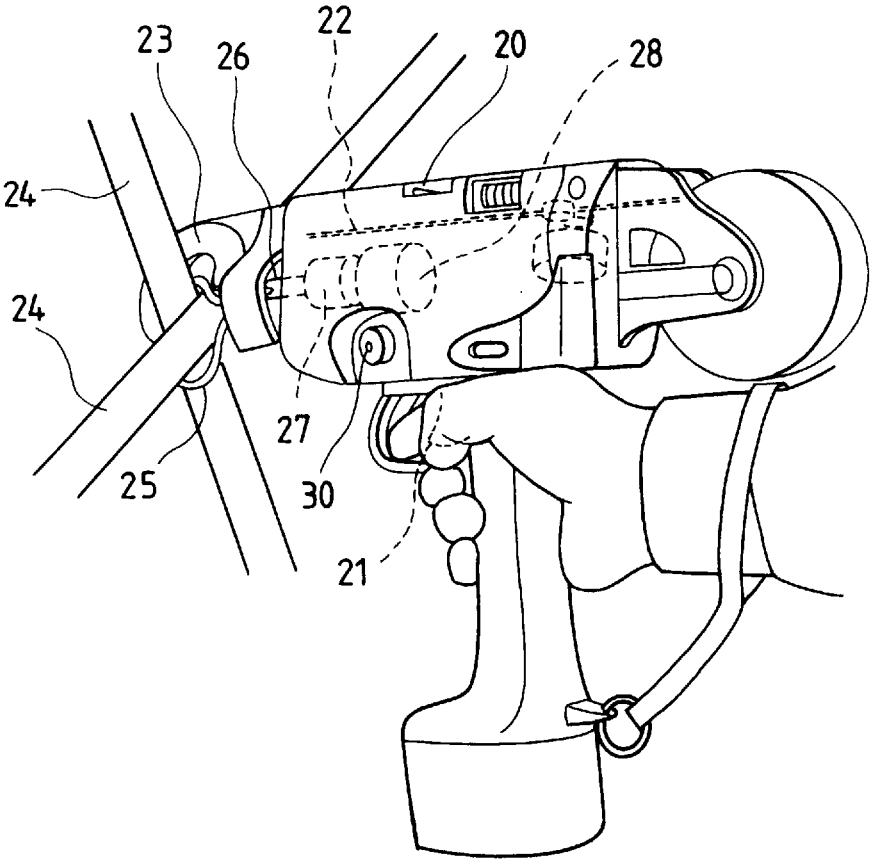
FIG. 5 is a perspective view showing how a conventional reinforcing bar fastening machine is used.
Figure 6:
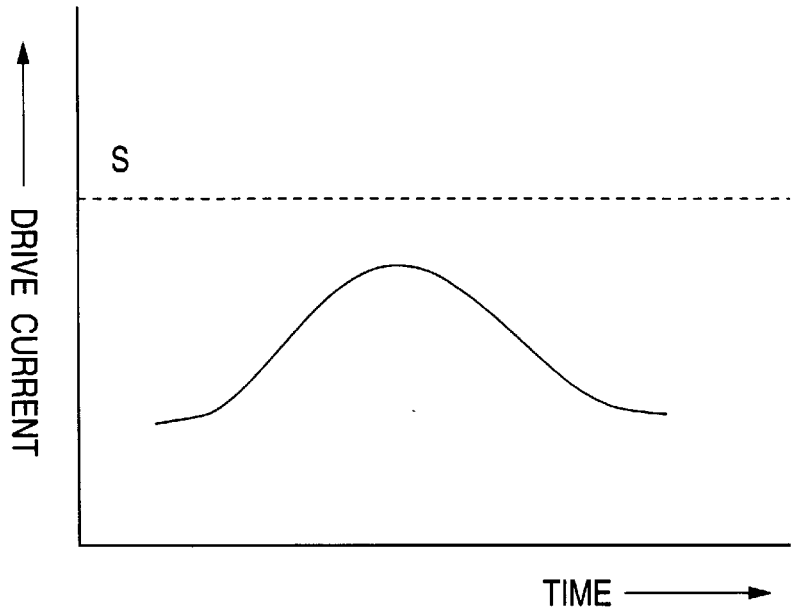
FIGS. 6(*a*) and 6(*b*) are drive current characteristic diagrams of a motor of the conventional reinforcing bar fastening machine.
Figure 6:
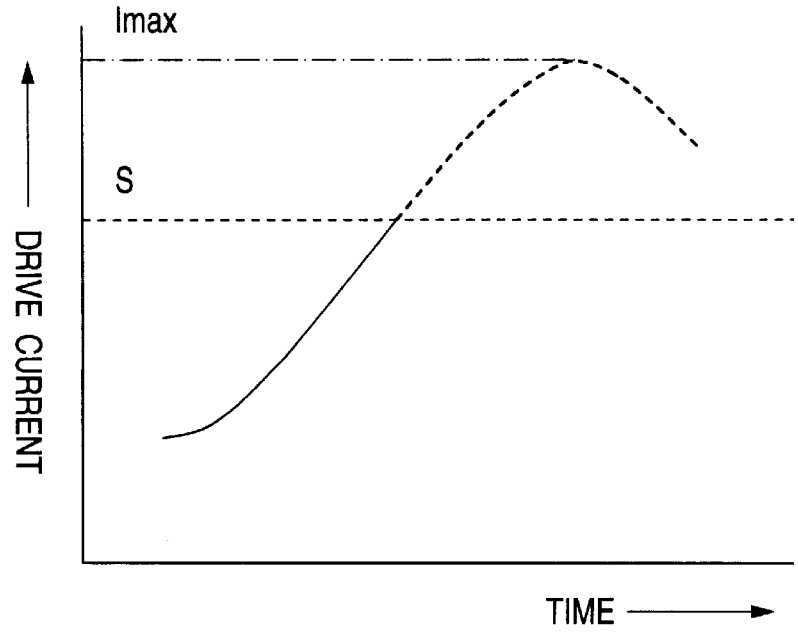

According to this method, the fastening end timing is determined by measuring only changes in torque (drive current). Therefore, as indicated by the drive current characteristic curve of the motor shown in FIG. 4(*a*), in the case of a highly rigid wire, the tying operation by twisting can be brought to an end at a strong torque, whereas in the case of a less rigid wire, the tying operation by twisting can be brought to an end at a weak torque (see FIG. 4(*b*)). As a result, no special consideration should be given at all to the rigidity of a wire (the type of a wire) and the looped condition of a wire. Hence, the optimal fastened condition can always be obtained.

Since the tying operation by twisting is automatically stopped under the optimal condition by monitoring the twisted condition of a wire, not only the twisting off of the wire due to excessive twisting can be prevented, but also a strong fastening force can be obtained. In addition, there is no need to change the torque setting in accordance with the type of a wire (the rigidity of a wire). Hence, the invention can provide a highly operable method of preventing a wire from being twisted off in a reinforcing bar fastening machine.

What is claimed is:

1. A method of preventing a wire from being twisted off in a reinforcing bar fastening machine having a wire feed device for feeding a wire for fastening reinforcing bars, a guide arm for guiding the wire so as to wind around a crossing point of the reinforcing bars in the form of a loop, a twisting device for performing a tying operation by twisting while picking up part of the loop of the wire wound around the crossing point of the reinforcing bars, and a cutting device for cutting the loop from the wire on a reinforcing bar fastening machine side, the method comprising the steps of:

monitoring a torque of a motor for driving the twisting device from an operation start timing of the twisting device; and bringing the tying operation by twisting performed by the twisting device to an end upon detection of a peak of the torque.

2. The method of preventing a wire from being twisted off in a reinforcing bar fastening machine according to claim 1, wherein the torque is monitored in every 1 ms in the monitoring step, and bringing the tying operation to the end when the torque does not increase for 4 ms.

3. The method of preventing a wire from being twisted off in a reinforcing bar fastening machine according to claim 1, wherein the bringing step includes turning off a power transistor which connect to the motor in sequence.

* * * * *